US007762852B2

(12) United States Patent
Daly et al.

(10) Patent No.: US 7,762,852 B2
(45) Date of Patent: Jul. 27, 2010

(54) D-SUBMINIATURE CONNECTOR ASSEMBLIES AND A HOUSING THEREFORE

(75) Inventors: Peter R. Daly, Yorktown Heights, NY (US); Christopher J. Poulin, Carmel, NY (US)

(73) Assignee: BTX Technologies, Inc., Hawthorne, NY (US)

( * ) Notice: Subject to any disclaimer, the term of this patent is extended or adjusted under 35 U.S.C. 154(b) by 0 days.

(21) Appl. No.: 12/392,490

(22) Filed: Feb. 25, 2009

(65) Prior Publication Data

US 2009/0221187 A1 Sep. 3, 2009

Related U.S. Application Data

(60) Provisional application No. 61/032,307, filed on Feb. 28, 2008.

(51) Int. Cl.
*H01R 25/00* (2006.01)

(52) U.S. Cl. ..... 439/638; 439/562; 439/564; 439/569; 439/571; 439/573

(58) Field of Classification Search ..... 439/638, 439/562, 564, 573, 569, 571
See application file for complete search history.

(56) References Cited

U.S. PATENT DOCUMENTS

| | | | | |
|---|---|---|---|---|
| 5,340,333 | A * | 8/1994 | Schroth | 439/607.25 |
| 5,628,653 | A * | 5/1997 | Haas et al. | 439/607.04 |
| 6,875,052 | B1 * | 4/2005 | Lo et al. | 439/564 |
| 7,070,454 | B1 * | 7/2006 | Pepe et al. | 439/638 |
| 7,429,194 | B2 * | 9/2008 | Poulin et al. | 439/596 |

* cited by examiner

*Primary Examiner*—Tho D Ta
(74) *Attorney, Agent, or Firm*—Leason Ellis LLP

(57) ABSTRACT

In one exemplary embodiment, an electrical connector including a D-subminiature connector assembly that includes a base; a D-subminiature connector mounted to the base; and a header mounted to the base. The header has a plurality of internal contacts and an open rear end for receiving a receptacle that includes conductive contacts that are electrically connected to the internal contacts when the receptacle is fully inserted into and engaged with the header.

25 Claims, 10 Drawing Sheets

D-SUBMINIATURE CONNECTOR ASSEMBLIES AND A HOUSING THEREFORE

CROSS-REFERENCE TO RELATED APPLICATIONS

The present application claims the benefit of U.S. patent application Ser. No. 61/032,307, filed Feb. 28, 2008 which is hereby incorporated by reference in its entirety.

TECHNICAL FIELD

The present invention relates generally to an electrical connector and more particularly, an electrical connector that can be used in combination with a hood and cable assembly for electrically connecting one member to another member.

BACKGROUND

It is often necessary and desirable to electrically connect one component to another component especially in the ever expanding world of computers and electronics, especially in multi-media applications and settings. A number of different interfaces can be used depending upon the precise nature of the setting.

More specifically, it is often necessary in the low voltage electronic systems integration industry, such as home theater, broadcasting and audio visual, to interconnect many different devices that create a whole system. A large portion of these devices use D-subminiature connectors as the external connection medium. D-subminiature connectors are readily and easily visible in such devices as computer monitors (high density 15 pin D-subminiature), control systems (9 pin standard D-subminiature), video switchers (9 pin standard D-subminiature), audio switchers (25 pin standard D-subminiature) just to name a few.

The D-subminiature connectors are typically installed in a wide number of locations and settings, many of which have specific special constraints. For example, the D-subminiature connectors can be installed in custom cabinetry, surface mount electrical boxes, floor pockets, and other space-limited locations. Unfortunately, there are a number of deficiencies and limitations that are present when trying to install connectors into these locations that have special constraints.

SUMMARY

In one exemplary embodiment, an electrical connector including a D-subminiature connector assembly that includes a base; a D-subminiature connector mounted to the base; and a header mounted to the base. The header has a plurality of internal contacts and an open rear end for receiving a receptacle that includes conductive contacts that are electrically connected to the internal contacts when the receptacle is fully inserted into and engaged with the header.

In another embodiment, an electrical connector includes a D-subminiature connector assembly that includes a base including a substrate and a printed circuit board; and a D-subminiature connector mounted to the substrate. The D-subminiature connector has pin contacts and the connector assembly further includes a terminal block mounted to the substrate and spaced from the D-subminiature connector. The terminal block has individual terminal openings for receiving wires associated with an electrical cable. Each terminal opening is defined by an axis that extends therethrough and intersects a horizontal plane containing the base. The terminal block includes an extra terminal that is electrically connected to the pin contacts of the D-subminiature connector via the printed circuit board. The circuit is completed by inserting a shield of the cable into the extra terminal.

An electrical connector includes a D-subminiature connector assembly that has a base; a D-subminiature connector mounted to the base; and an Ethernet connector mounted to the base for receiving a modular plug that includes pins that are electrically connected to twisted pairs of wires contained in a single cable jacket (e.g., cat5 cable). The Ethernet connector has a plurality of internal contacts and an open rear end for receiving the modular plug so that when the modular plug is inserted into the Ethernet connector, the pins of the plug are electrically connected to the internal contacts.

In another embodiment, the present invention relates to a housing for attachment to an electrical connector, such as one of the above electrical connectors. The housing includes a base portion having a support surface for supporting the electrical connector and a pair of upstanding fastening support structures that extend upward from the base portion. The housing includes a resilient latch member that is disposed below the base portion to assist in attaching the electrical connector to the housing. A space is formed between the resilient latch member and the underside of the base portion. The latch member includes a pair of locking members to assist in attaching the electrical connector to the housing. The housing has a height that is equal to or less than a height of the electrical connector and the housing has an open top to permit the electrical connector to be accessed.

A panel mount for use with an electrical connector includes a support member having a front edge and a rear edge and a pair of side wall supports that extend upwardly from the support member and serve to limit the side to side motion of the electrical connector. Each side wall support includes a resilient side clip that has a free end closer to the rear edge. The side clip is spaced above an upper surface of the support member such that a space is formed between a bottom edge of the side clip and the upper surface. The side clip is configured to restrict vertical motion of the electrical connector. In addition, the panel mount includes a pair of mount members that extend laterally from the side wall supports for placement against a panel and a means for limiting front to back motion of the electrical connector.

BRIEF DESCRIPTION OF THE DRAWING FIGURES

The foregoing and other features of the present invention will be more readily apparent from the following detailed description and drawings figures of illustrative embodiments of the invention in which.

Figure 22A:
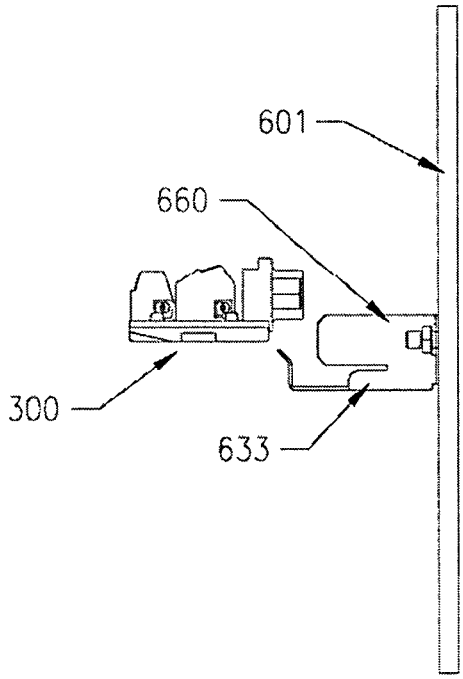
Figure 22B:
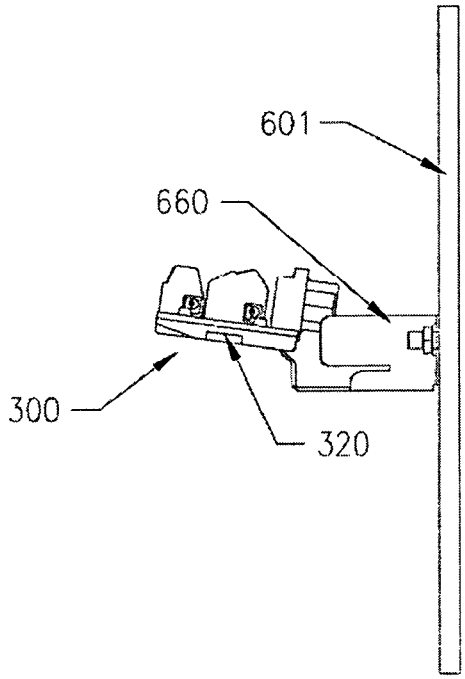
Figure 22C:
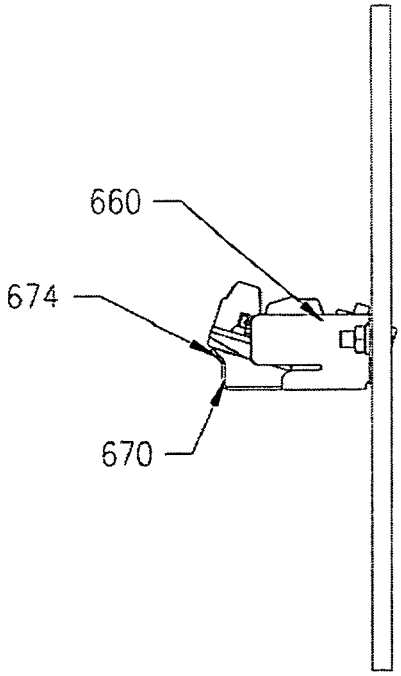
Figure 22D:
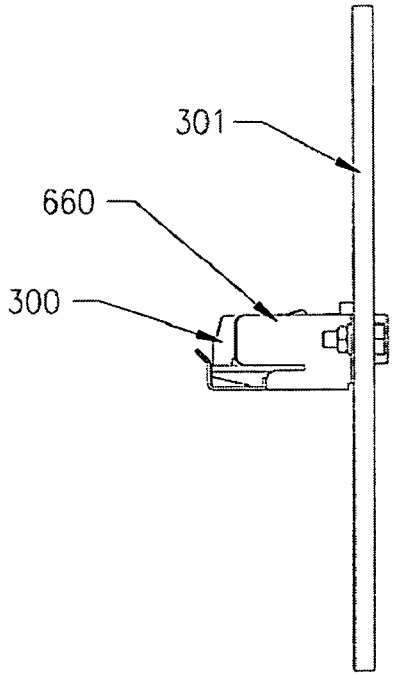
Figure 23:
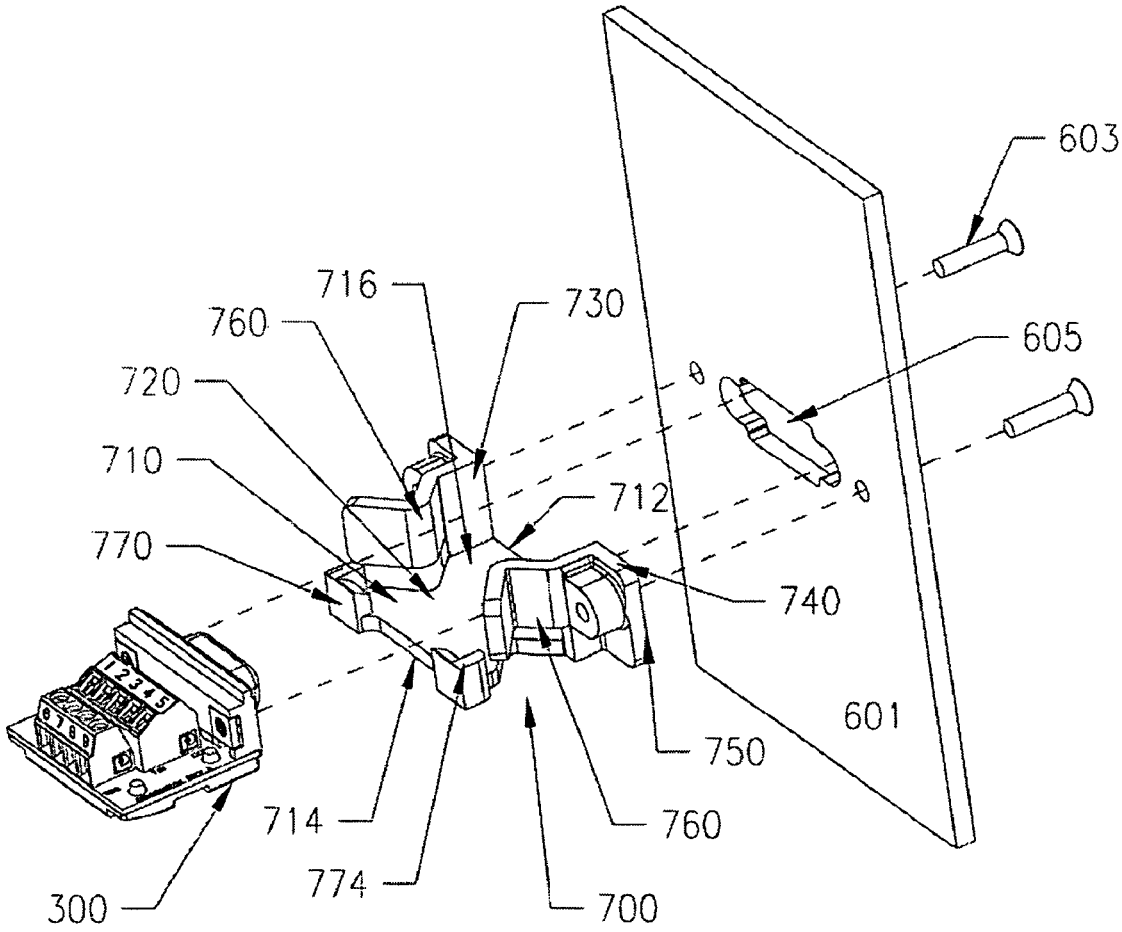

FIGS. 22A-D are side elevation views showing the electrical connector being received into and securely held within the plate mount; and FIG. 23 is an exploded perspective view of a plate mount according to a second embodiment for attachment to an electrical connector.

DETAILED DESCRIPTION OF PREFERRED EMBODIMENTS

Now referring to FIGS. 1-4, a D-subminiature connector assembly 100 according to a first embodiment of the present invention is illustrated. The connector assembly 100 can be of a standard density 9 pin female design. The electrical connector assembly 100 includes a first connector component (D-sub component) 110 that includes one or more rows of sockets (not shown) that are surrounded by D-shaped shield 112 (plastic or metal) that provides screening against electromagnetic interference. The D-shape guarantees correct orientation. It will be understood that the nomenclature "D-subminiature" is a connector system and it defines a range of connectors with varying numbers of poles (contacts) and further, there is most often, a "shell size" nomenclature that is associated with D-subminiature connectors and in particular, with the dimensions of the shield 112. Shield 112 extends forward of a flange 114 that is part of the connector component 110.

With such parts, a D is used as the prefix for the whole series, followed by a letter denoting the shell size (A=15 pin, B=25 pin, C=37pin, D=50 pin; E=9 pin), followed by the actual number of pins, followed by the gender (M=male, F=female). Further, D-subminiature connectors also come in standard and high density. For instance, a 9 pin D-sub and a high density 15 pin D-sub both utilize the "E" shell size. Therefore, anywhere a 9 pin D-sub can be placed, a high density 15 pin D-sub can likewise be used.

The connector assembly 100 also includes a header 120 that includes a number of openings (terminals) 122 that receive and retain wires or the like that are then electrically connected to the contacts of the D-subminiature connector 110 by means of a conductive pattern (leads) that provide an electrical pathway between each pin of the D-subminiature connector 110 and the conductive wire or the like that is inserted and retained within one terminal 122 of the header 120. For purpose of illustration, a cable 124 is illustrated in the figures and it will be understood that the cable 124 includes a number of individual wires that are inserted into the individual terminals 122 of the header 120 as described below.

In the illustrated embodiment, the header 120 is in the form of a single row header that has a first end 123 that faces the D-subminiature connector 110 and an opposing second end 125 that faces in an opposite direction. In the illustrated embodiment, the header 120 has a rectangular shape and is open along the second end 125. As described below, the header 120 provides a means for receiving and mating with another component that carries electrical contacts that are electrically connected through insertion into the header 120 to other contacts that are part of the assembly 100. The header 120 thus includes at least one means 128 for coupling the other component to the header 120. For example, the coupling means 128 can be in the form of a plurality of axially aligned slots that are formed along a ceiling 129 of the header 120.

The illustrated header 120 is a single row right angle header since the contacts that are received into the open second end 125 are oriented at a ninety degree (right angle) relative to the internal contacts that electrically connect the header 120 to other components of the assembly 100, including the D-subminiature connector 110.

As mentioned above, the header 120 is designed to mate with another electrical component that carries electrical contacts and in particular, the header 120 is designed to mate with a receptacle 200 that carries the conductive members that are mated to the D-subminiature connector 110. The receptacle 200 can be in the form of a screw terminal or spring clamp style of receptacle. The receptacle 200 has a housing 210 that includes a plug portion 220 that is received into the open second end 125 of the header 120. The plug portion 220 extends outwardly from a main body 230 that has an end 232 in which a plurality of terminal (openings) 234 are formed. As with the header 120, the receptacle 200 is in the form of a single row in that the terminals 234 are formed along a single row.

The terminals 234 are designed to receive conductive members, such as wires, that are inserted into and held in place within the terminals 234 by conventional means (e.g., biasing or fastening means) in such a manner that the conductive members are placed in electrical contact with the internal contacts that are formed in the header 120. The illustrated main body 230 thus has a straight wire entry from the rear to receive the conductive members (wires).

In the case of a 9 pin D-subminiature design, there are 9 terminals (so numbered terminals 1-9) formed within both the header 120 and the receptacle 200; however, it will be appreciated that the header 120 and receptacle 200 can include any number of terminals depending upon the type and characteristics of the D-subminiature connector 110.

In order to properly align the receptacle 200 with the header 120 so that it is received properly therein, the plug portion 220 includes locating members 240 that are configured to mate with the coupling means 128 (axially aligned slots) that are formed along a ceiling 129 of the header 120. For example, the locating members 240 can be in the form of a plurality of axially aligned tabs, fingers, or rails that are formed along a top surface 221 of the plug portion 220. The spacing between the locating members 240 is complementary to the spacing between the slots 128 and the relative dimensions between the two members are selected so that when the plug portion 220 is received into the header 120, the locating members 240 are received into the slots 128. This results in the conductive members (wires) in the terminals 234 being properly individually aligned with the respective internal contacts of the header 120.

It will be appreciated that the structure of the receptacle 200 permits the conductive members to be pre-installed therein prior to mating and coupling the receptacle 200 to the header 120, thereby coupling the receptacle 200 to the connector assembly 100. In other words, the conductive members (wires) are simply inserted into respective terminals 234 and secured therein and then the plug portion 220 is inserted into the open second end 125 of the header 120 and secured thereto resulting in the conductive members being placed in electrical contact with the internal contacts that are formed in the header 120.

The assembly 100 also includes a substrate 130 that includes a floor 132 to which the D-subminiature connector 110 and the header 120 are attached and typically, the substrate 130 has either a rectangular or square shape that is defined by a front edge 134, an opposing rear edge 136 and a pair of side edges 138 that extend therebetween.

The assembly 100 further includes a cover 140 that mates with the substrate 130 and also interfaces with a printed circuit board 150. The cover 140 is designed to protect the printed circuit board 150 and is thus, disposed between the printed circuit board 150 and the substrate 130. In order to permit the cover 140 to be coupled to the substrate 130, the cover 140 and substrate 130 include complementary features that permit the secure coupling between the two. For example, the substrate 130 can include one or more openings or slots 131 and the cover 140 includes one or more protrusions 142 that serve as locating means for aligning the substrate 130 and cover 140 relative to one another, as well as serving as coupling means. In particular, the protrusions 142 are received into the corresponding openings 131. A heat staking process (a controlled melting of protrusions 142) between the protrusions 142 and the openings 131 results in the coupling between the two members.

It will therefore be appreciated that the cover 140 has a complementary shape relative to the substrate 130. Accordingly, the cover 140 is generally a square shape with two opposing end edges 141 and two opposing side edges 143.

In the illustrated embodiment, the openings 131 are in the form of a first pair of openings that are formed in a space between the D-subminiature connector 110 and the header 120.

The cover 140 also includes a first recess 144 for accommodating the pins of the D-subminiature connector 110 and a slot 146 for accommodating the header 120. The recess 144 and slot 146 protect the contacts from being damaged and possibly shorting to one another. This design also allows a reduction in the overall height of the connector assembly 100 as opposed to more of a "tray" type cover design that is used in conventional connector assemblies. The recess 144 and slot 146 also permit the connector assembly 100 to be used with a housing or hood, which is described in detail below. In the illustrated embodiment, the recess 144 and slot 146 are in the form of rectangular slots; however, it can be other shapes. The recess 144 is formed below the D-subminiature connector 110 to permit the pins thereof to be accommodated and the slot 146 is below the header 120 to permit the internal contacts (pins) thereof to be accommodated.

Figure 1:
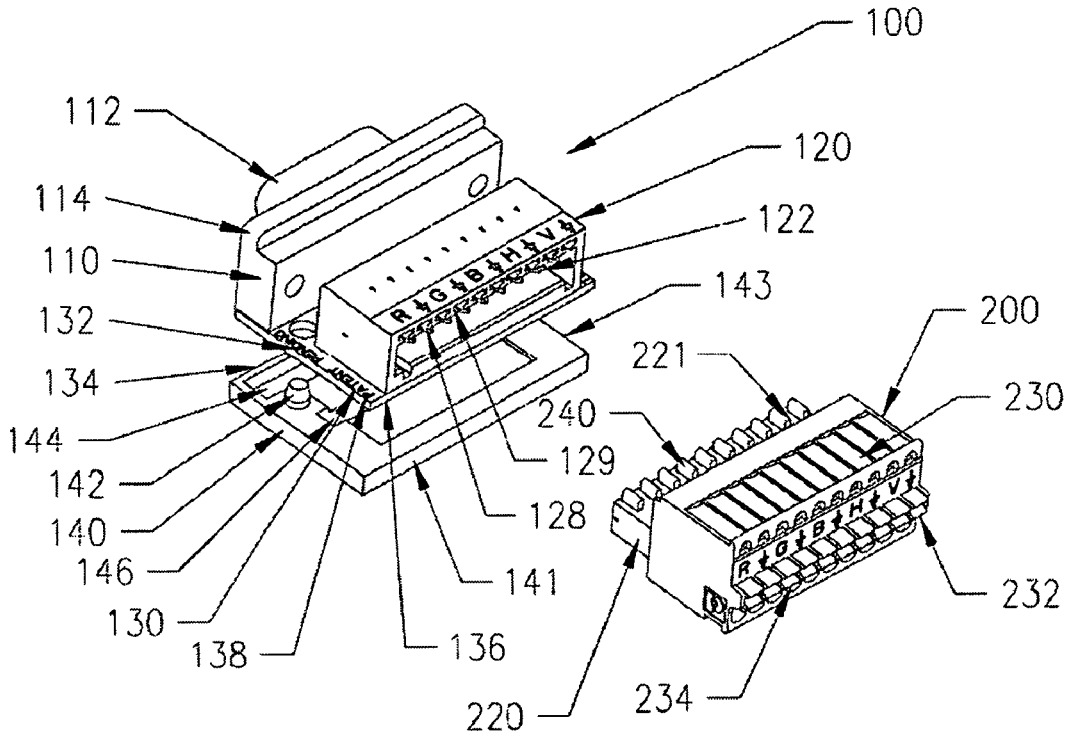
FIG. 1 is an exploded perspective view of a connector assembly according to a first embodiment of the present invention.
Figure 2:
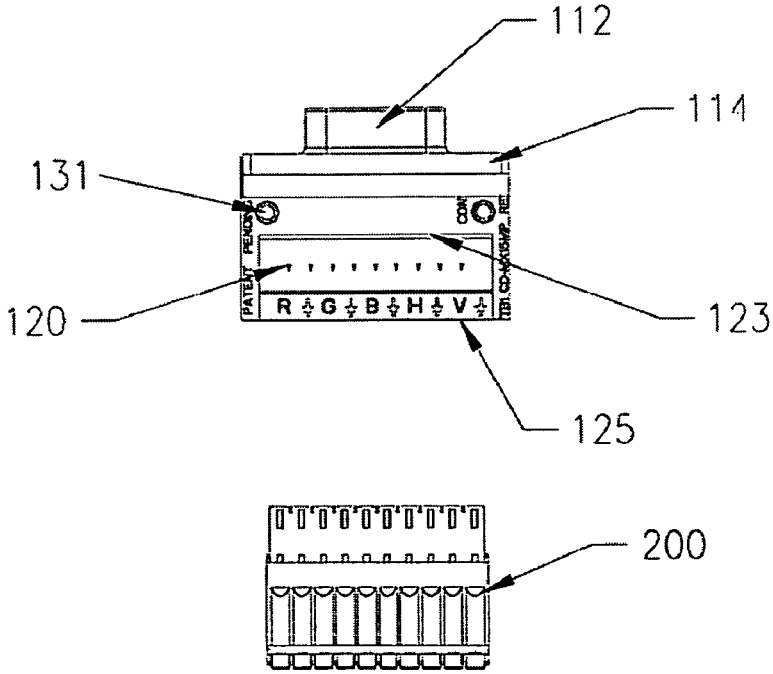
FIG. 2 is an exploded top plan view of the connector assembly of FIG. 1.
Figure 3:
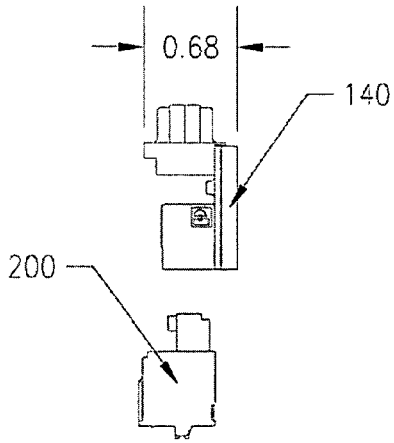
FIG. 3 is an exploded side elevation view of the connector assembly of FIG. 1.
Figure 4:
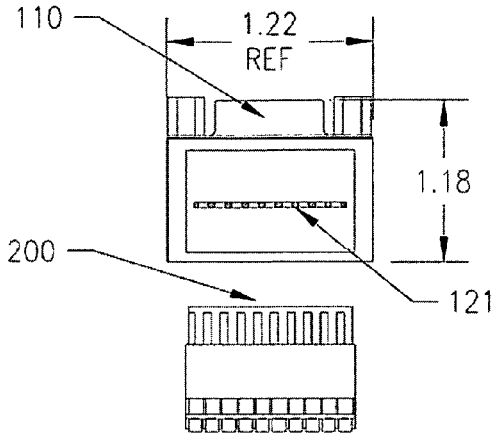
FIG. 4 is an exploded bottom plan view of the connector assembly of FIG. 1.
Figure 5:
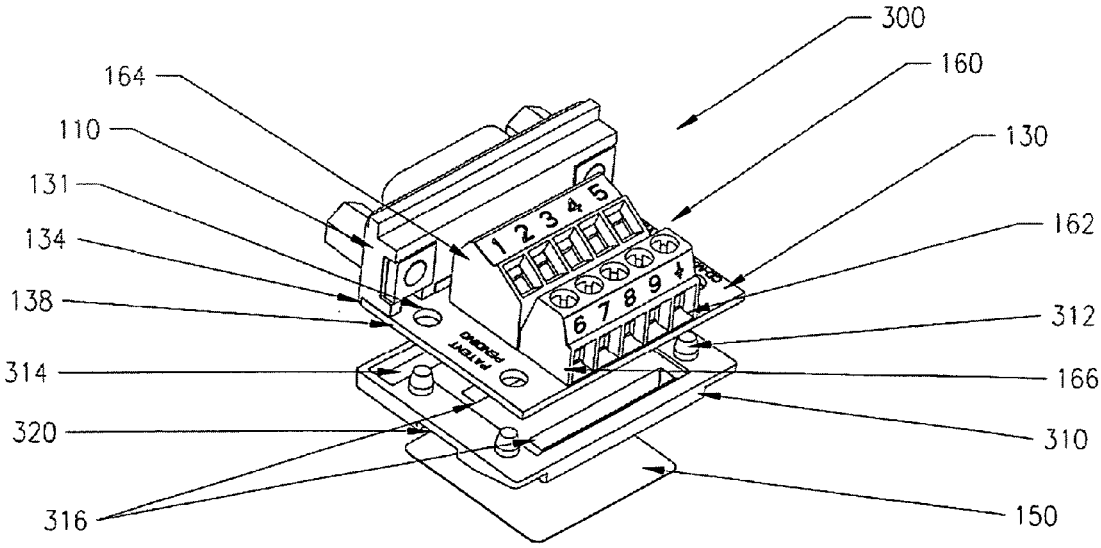
FIG. 5 is an exploded perspective view of a connector assembly according to a second embodiment of the present invention.

FIGS. 2-4 show other view of the assembly 100 and receptacle 200. In one illustrated, the height of the D-subminiature connector 110 mounted to the substrate 130 and cover 140 is about 0.68 inches, while the width of the assembly 100 (as measured from one side to the other side) is about 1.22 inches. The length of the assembly 100, measured from the forward-most portion of the D-subminiature connector 110 to the rear edge of the header 120 and substrate 130 is about 1.18 inches.

Now referring to FIGS. 5-8 in which a connector assembly 300 according to a second embodiment is illustrated. The assembly 300 is similar to the assembly 100 and therefore, like components are numbered alike. In particular, the assembly 100 includes the D-subminiature connector 110 and substrate 130.

Instead of having header 120 and receptacle 200 as the assembly 100 includes, the assembly 300 has a terminal block design. More specifically, the connector assembly 300 includes a terminal block 160 that includes a number of openings (terminals) 162 that receive and retain wires or the like that are then electrically connected to the contacts of the D-subminiature connector 110 by means of a conductive pattern (leads) that provide an electrical pathway between each pin of the D-subminiature connector 110 and the conductive wire or the like that is inserted and retained within one terminal 162 of the block 160.

In the illustrated embodiment, the terminal block 160 includes two rows of the terminals 162, namely, a first terminal row 164 and a second terminal row 166. In the case of a 9 pin design, as shown, the first terminal row 164 includes 5 terminals 162 (so numbered terminals 1-5) and the second terminal row 166 includes 5 terminals 162 (so numbered terminals 6-9 and a ground terminal). The first terminal row 164 is disposed between the second terminal row 166 and the D-subminiature connector 110 Unlike conventional terminals block design, the wire entry on the first terminal block row 164 that is closest to the D-subminiature connector 110 has an angled wire entry so that the wires are angled as they enter the first terminal block row 164. In particular, the terminal openings are formed at an angle relative to the plane containing the base such that the terminal openings do not exceed the height of the D-subminiature connector and still allow for the wires to be routed over the terminal block behind it as well as leaving enough space for a hood to be applied. For example, the angle of entry for the wires in the first terminal block row 164 can be about 55 degrees. Conventionally, both rows of terminal blocks have straight wire entry from the rear, such as the entry in second terminal row 166.

By angling the entry into the first terminal block row 164, the overall height of the connector assembly 300 can be significantly reduced.

In this embodiment, the D-subminiature connector 110 is a 9 pin D-subminiature connector; however, the terminal block 160 is of a ten terminal 162 design. Thus, each of the first and second terminal block rows 164, 166 is of a five terminal (pin) design. The extra position ($10^{th}$ terminal) that is part of the second terminal block row 166 is electrically tied to anchor pins (shell anchor pins) of the D-subminiature connector 110 via the printed circuit board 150. The shield of the cable is inserted into this $10^{th}$position on the terminal block 160, thereby completing the circuit.

The assembly 300 further includes a cover 310 that mates with the substrate 130 and also interfaces with the printed circuit board 150. The cover 310 is designed to protect the printed circuit board 150 and is thus, disposed between the printed circuit board 150 and the substrate 130. In order to permit the cover 310 to be coupled to the substrate 130, the cover 310 and substrate 130 include complementary features that permit the secure coupling between the two. For example, the substrate 130 can include one or more openings or slots 131 and the cover 310 includes one or more protrusions 312 that serve as locating means for aligning the substrate 130 and cover 310 relative to one another, as well as serving as coupling means. In particular, the protrusions 312 are received into the corresponding openings 131. A heat staking process (a controlled melting of protrusions 312) between the protrusions 312 and the openings 131 results in the coupling between the two members.

It will therefore be appreciated that the cover 310 has a complementary shape relative to the substrate 130. Accordingly, the cover 310 is generally a square shape with two opposing end edges 311 and two opposing side edges 313.

In the illustrated embodiment, the openings 131 are in the form of a first pair of openings that are formed on the sides of the first terminal block row adjacent the D-subminiature connector 110 and a second pair of openings that are formed on the sides of the second terminal block row near the edge of the substrate 130.

The cover 310 also includes a first recess 314 for accommodating the pins of the D-subminiature connector 110 and a pair of slots 316 for accommodating the terminal blocks 160. The recess 314 and slots 316 protect the contacts from being damaged and possibly shorting to one another. This design also allows a reduction in the overall height of the connector assembly 300 as opposed to more of a "tray" type cover design that is used in conventional connector assemblies. The recess 314 and slots 316 also permit the connector assembly 300 to be used with a hood, such as the one disclosed in commonly assigned U.S. patent application Ser. No. 11/743,017, filed May 1, 2007, which is hereby incorporated by reference in its entirety.

In the illustrated embodiment, the recess 314 and slots 316 are in the form of rectangular slots; however, it can be other shapes. The recess 314 is formed below the D-subminiature connector 110 to permit the pins thereof to be accommodated and one slot 316 is formed between the protrusions 312.

The protective cover 310 also includes one or more notches 320 formed therein and in particular, the notch 320 is formed along one side edge 313. Each notch 320 matches up with the hood for snap-lockingly mating the two together.

Figure 6:
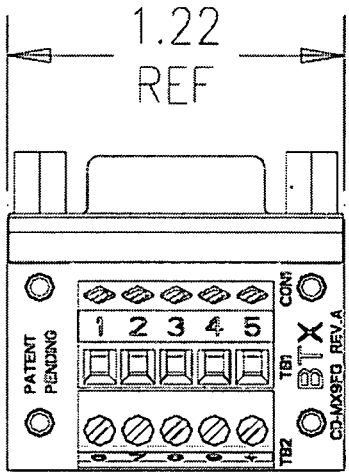
FIG. 6 is a top plan view of the connector assembly of FIG. 5.
Figure 7:
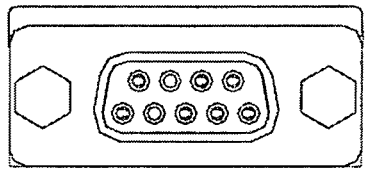
FIG. 7 is a front elevation view of the connector assembly of FIG. 5.
Figure 8:
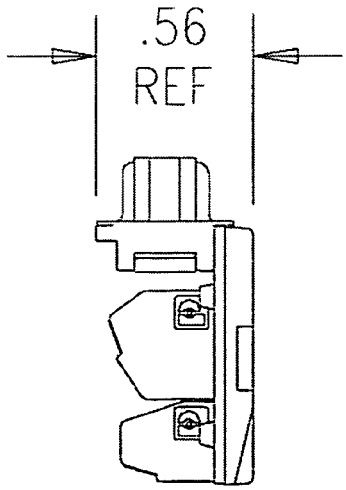
FIG. 8 is a side elevation view of the connector assembly of FIG. 5.
Figure 9:
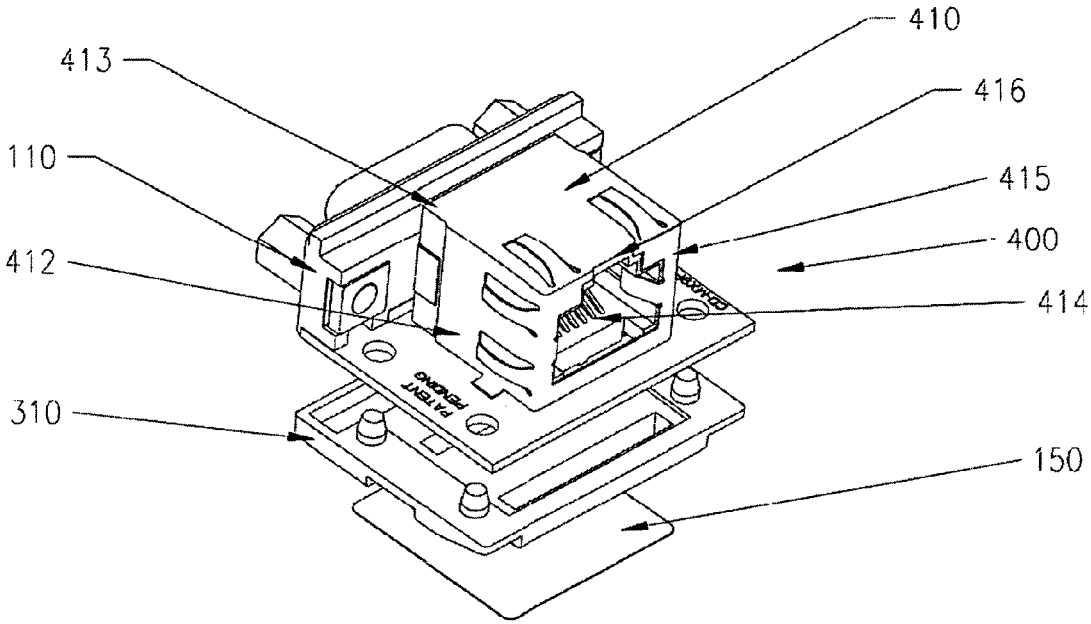
FIG. 9 is an exploded perspective view of a connector assembly according to a third embodiment of the present invention.

FIGS. 6-8 show other view of the assembly 300. In one illustrated, the height of the D-subminiature connector 110 mounted to the substrate 130 and cover 310 is about 0.56 inches, while the width of the assembly 300 (as measured from one side to the other side) is about 1.22 inches. The length of the assembly 300, measured from the forwardmost portion of the D-subminiature connector 110 to the rear edge of the terminal block 160 and substrate 130 is about 1.16 inches.

Now referring to FIGS. 9-12 in which an electrical connector assembly 400 according to a third embodiment is illustrated. The assembly 400 is constructed to provide an economical connector option for running cable, cat5 or Ethernet cable. The assembly 400 is particularly suited for the instance where there is pre-existing cable installed in a structure.

The assembly 400 includes the D-subminiature 110 which is preferably in the form of a slim D-subminiature connector 110. In this embodiment, instead of having a terminal block construction, the assembly 400 has a cat5 connector 410 that forms a part of the assembly 400. The cat5 connector 410 includes a housing 412 that has an open end 415 for receiving a cat5 cable. As will be appreciated the housing 412 is hollow and therefore within the housing 412, there are internal contacts 414 that are electrically connected to the printed circuit board 150 and ultimately to the D-subminiature connector 110 through the printed circuit board 150.

The housing 412 also has conventional locking means 416 for locking the cat5 cable within the housing 412. As is known, the end of the cat5 cable has a complementary connector that mates with the housing 412. The electrical contacts (wires) in the cat5 cable connector are electrically connected to the internal contacts 414 in the housing 412 when the cat5 cable is securely attached to the cat5 connector 410. The cat5 cable connector also includes a locking means that is complementary to the locking means 416 and can be manipulated to disengage the cat5 cable connector from the housing 412. For example, the locking means can be in the form of a biased thumb or finger.

A forward edge 413 of the housing 412 faces and is spaced close to the rear of the D-subminiature connector 110.

In the illustrated embodiment, the assembly 400 also includes the substrate 130, the cover 310, and the circuit board 150. As with the other embodiments, the D-subminiature connector 110 and the cat5 connector 410 are securely attached to the top surface of the substrate 130.

Figure 10:
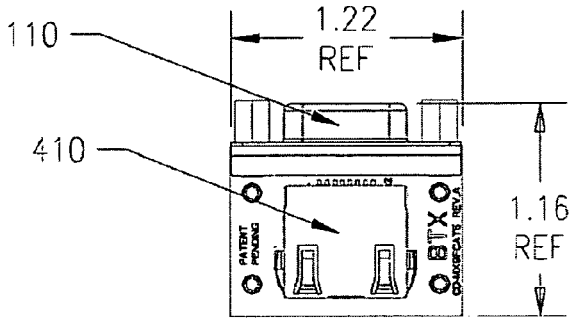
FIG. 10 is a top plan view of the connector assembly of FIG. 9.
Figure 11:
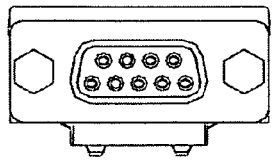
FIG. 11 is a front elevation view of the connector assembly of FIG. 9.
Figure 12:
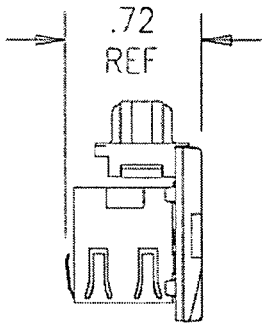
FIG. 12 is a side elevation view of the connector assembly of FIG. 9.

FIGS. 10-12 show other view of the assembly 400. In one illustrated, the height of the D-subminiature connector 110 mounted to the substrate 130 and cover 310 is about 0.72 inches (due to the height of the cat5 connector 410), while the width of the assembly 400 (as measured from one side to the other side) is about 1.22 inches. The length of the assembly 300, measured from the forwardmost portion of the D-subminiature connector 110 to the rear edge of the substrate 130 is about 1.16 inches.

FIGS. 13-19 illustrate a housing 500 that is designed to mate with many of the connector assemblies disclosed hereinabove. In particular, the housing 500 is in the form of a half hood that is configured to allow for strain relieving the cables and also enabling the use of thumbscrews. In addition, the housing 500 is particularly designed for use when the connectors on a panel are located very close horizontally.

The housing 500 is formed of a body that has a first or forward end 510 and an opposing second or rear end 512, as well as a top surface 520 and a bottom surface 522. The body of the housing 500 includes a pair of upstanding thumbscrew (fastener) support structures 530 that are configured to hold thumbscrews 531 that are used for fastening and attaching the connector assembly, such as connector assembly 300, to the housing 500. The upstanding support structures 530 have forward wall portions 532 through which the thumbscrews 530 extend. For example, the structures 530 can be vertical walls that are perpendicular to the top surface 520 of the housing body and include openings (holes) through which the thumbscrews extend and through which the thumbscrews can be manipulated as by turning or rotating the thumbscrews so as to lockingly engage complementary fastening features that are formed as part of the connector assembly, e.g., the D-subminiature connector 110.

The body of the housing 500 includes a support or tray portion 540 that defines the top surface 520. The support portion 540 has a first section 542 that extends to and terminates at the forward end 510 and a second section 544 that extends to and terminates at the rear end 512.

As can be seen in the figures, the forward sections of the structures 530 extend beyond the forward end 510 of the support portion 540, while the rear end 512 of the support portion 540 extends beyond the rear sections of the structures 530. The first section 542 can be relatively planar, while the second section 544 has a contoured surface.

In addition, the body of the housing 500 includes a retaining or locking feature 550 that permits the connector assembly to be interlockingly engaged with the housing 500. The illustrated feature 550 can be in the form of a pair of side fingers or tabs 552, each of which includes an inclined top surface 554. The inclined top surface 554 is thus in the form of an inclined ramp that can act as a cam surface. The first section 542 is thus formed in between the side tabs 552.

Figure 17:
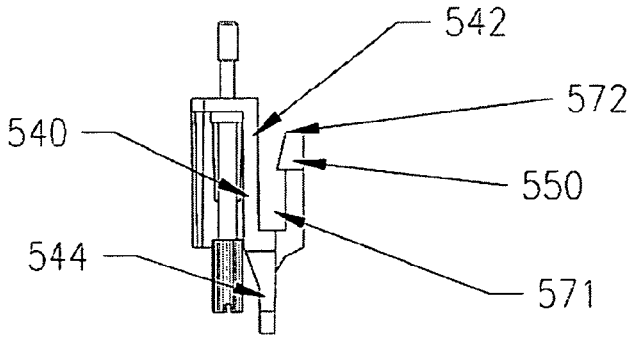
FIG. 17 is a side elevation view of the housing of FIG. 13.

As shown in FIG. 17, the second section 544 is not a planar member but instead has a sloped construction. In particular, the second section 544 slopes downward from the interface between the first and second sections 542, 544 toward the rear end of the housing body. The second section 544 includes a plurality of recessed channels or slots 560 formed along its top surface. The slots 560 are for cable ties.

The body of the housing 500 also includes a locking member 570 that is configured to lock the connector assembly to the housing 500. In the illustrated embodiment, the locking member 570 is in the form of a resilient tongue or finger that is formed below the support portion 540 such that a space 571 is formed between the underside of the support portion 540 and the top surface of the locking member 570. The locking member 570 is in the form of an elongated finger that includes a free end 572. The free end 572 has an inclined surface 574 and therefore, the free end 572 is in the form of a ramp structure. The ramp structure acts as a cam surface that assists in releasably locking the connector assembly to the housing 500.

Figure 13:
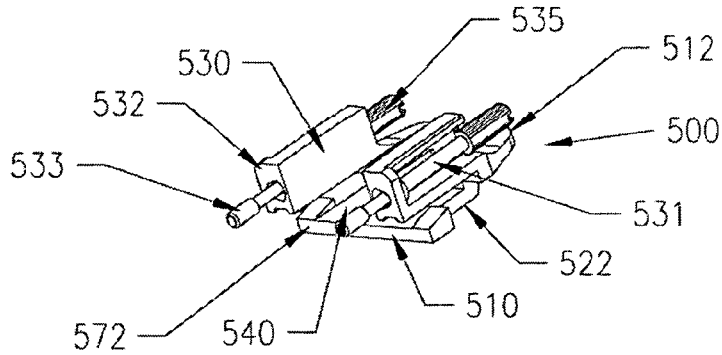
FIG. 13 is a perspective view of a housing for attaching to a connector.
Figure 14:
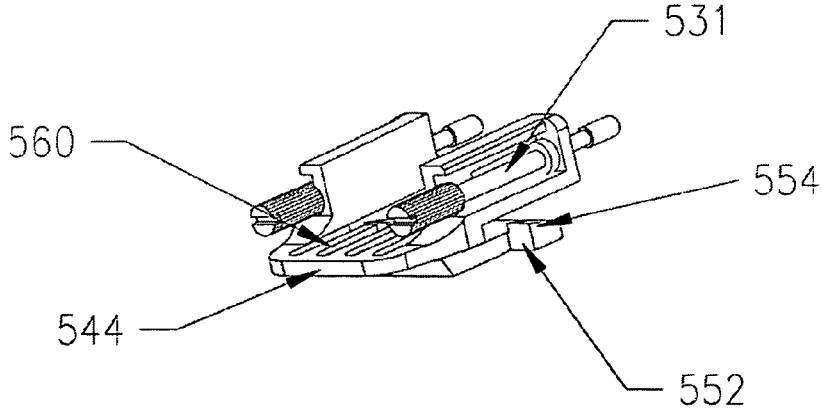
FIG. 14 is another perspective view of the housing of FIG. 13.
Figure 15:
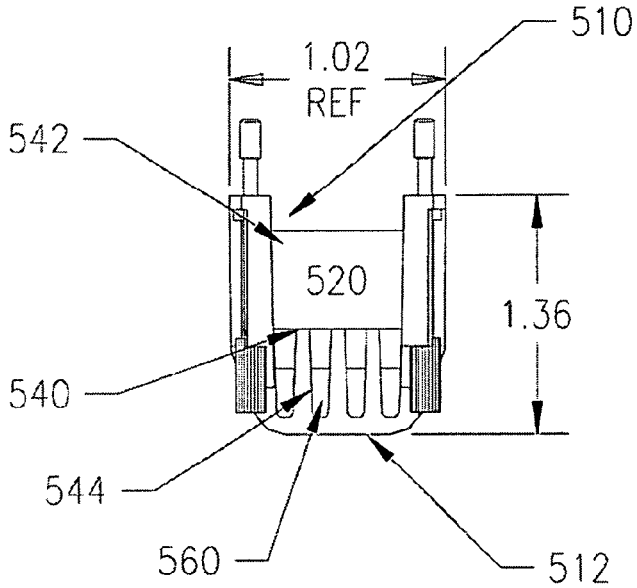
FIG. 15 is a top plan view of the housing of FIG. 13.
Figure 16:
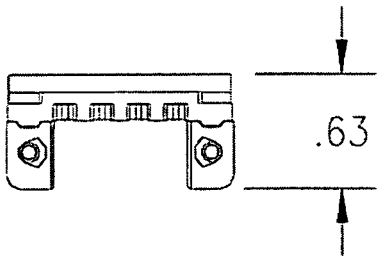
FIG. 16 is a front view of the housing of FIG. 13.

FIGS. 13 and 16 illustrate the forward end of the housing 500 including the thumbscrews 531. Each thumbscrew 531 has a forward end 533 that includes a means for fastening the thumbscrew 531 to the D-subminiature connector 110 and an opposite rear end 535 that is the portion that is grasped and rotated by the user. The rear end 535, as illustrated, can include a slot to permit insertion of a tool, such as a screwdriver head, for rotating the thumbscrew to securely attach the thumbscrew 531 to the D-subminiature connector 110. The shield 112 of the D-subminiature connector 110 can include a pair of fastener members 541 that are complementary to and are designed to fasteningly mate with the thumbscrew 531. For example, each fastener member 541 can be in the form of a hollow receptacle that protrudes outwardly from the forward end of the shield and includes internal fastening elements, such as threads. The forward ends 533 thus can have complementary threads that mate with the internal threads of the fastener member 541.

Figure 18:
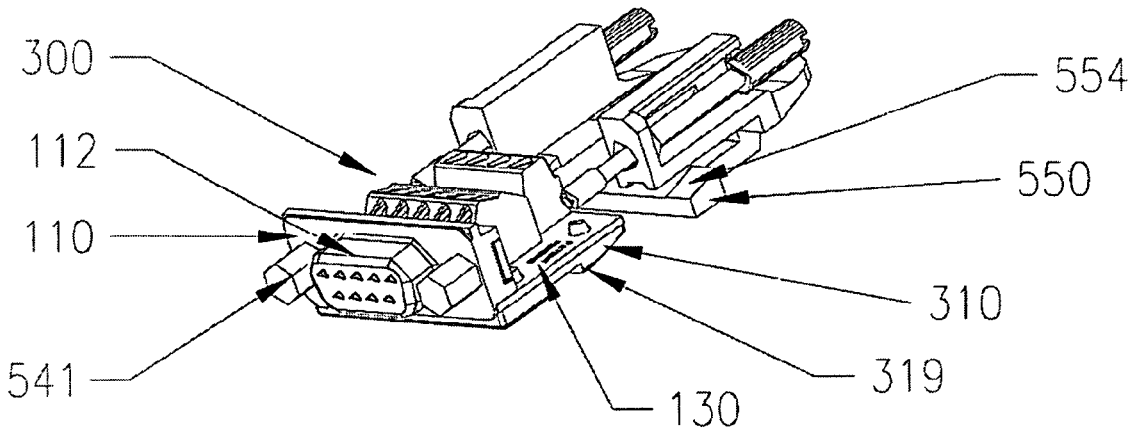
FIG. 18 is a perspective view of the housing of FIG. 13 and the connector, exploded therefrom, just prior to the connector being coupled thereto.
Figure 19:
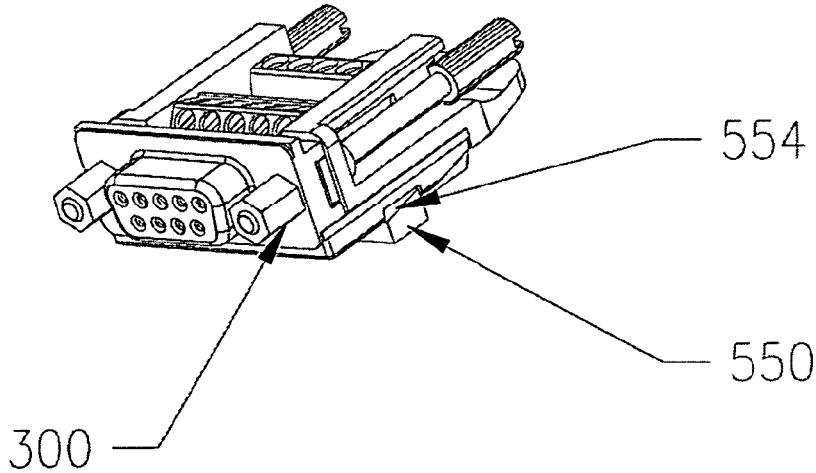
FIG. 19 is a perspective view of the connector securely attached to the housing of FIG. 13.
Figure 20:
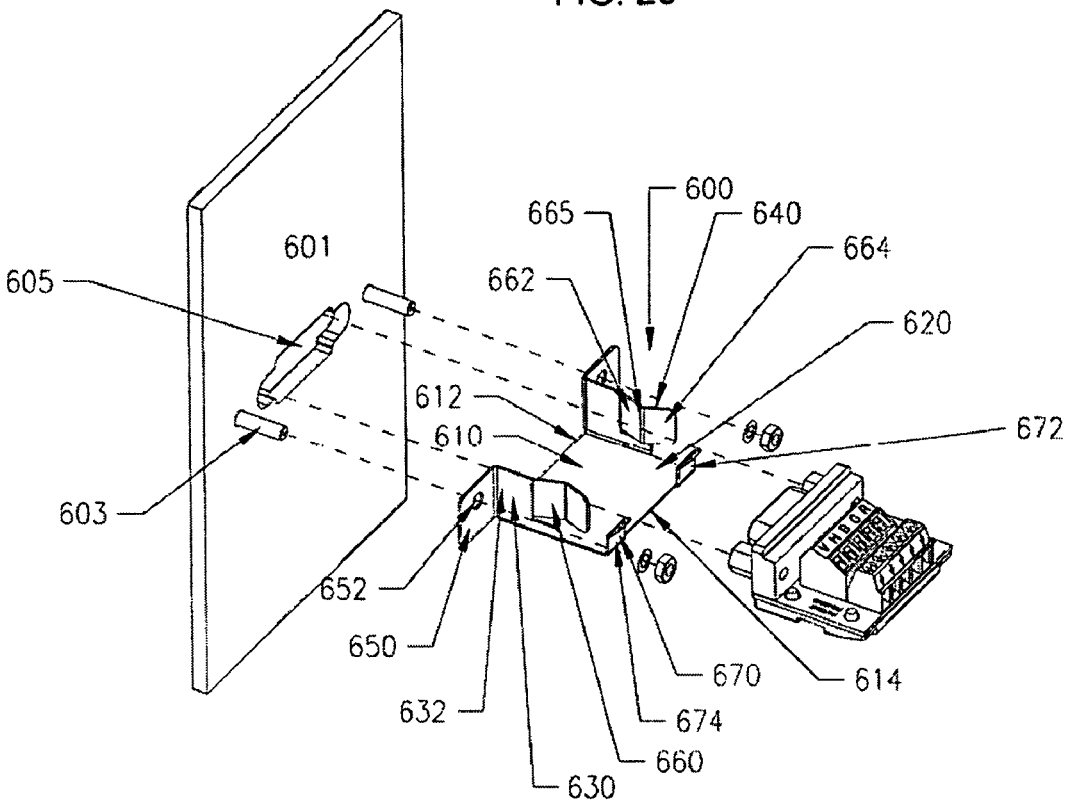
FIG. 20 is an exploded perspective view of a plate mount according to a first embodiment for attachment to an electrical connector.
Figure 21:
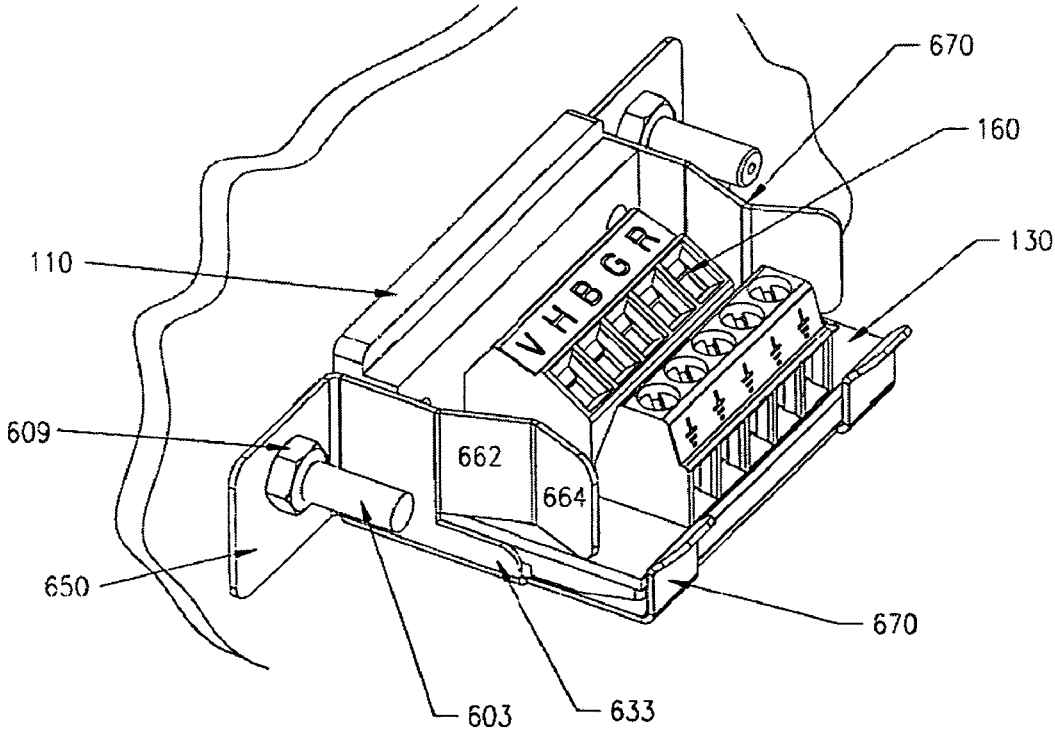
FIG. 21 is a perspective view of the plate mount in FIG. 20 with the electrical connector in the inserted, locked position.

FIGS. 18 and 19 illustrate the steps of receiving and locking the connector assembly 300 in place with the housing 500. As shown in FIG. 18, the assembly 300 is initially oriented so that the rear end of the assembly 300 faces the forward or front end 510 of the housing 500. The assembly 300 is also oriented so that the substrate 130, cover 310 and PCB 150 are generally aligned with the space 571 formed between the underside of the support portion 540 and the top surface of the locking member 570. The width of the terminal block 160 and the width between the support structures 530 are selected so that the terminal block 160 can be received therebetween in a locked position.

To lock the assembly 300 relative to the housing 500, the rear end of the assembly 300 is inserted into the space 571 and is moved toward the rear end or second section 544 of the housing 500. The rear end of the cover 310 has a ramped section 319 that has a complementary slope (opposite direction) relative to the slope of the inclined top surface 554 of the side tab 552. The ramped section 319 engages the inclined top surfaces 554 of the side tabs 552. Continued rearward movement of the assembly 300 causes the side tabs 552 to engage notches 320 formed in the underside and along the side edges of the cover 310. In particular, the inclined top surfaces 554 of the side tabs 552 engage and are received into the notches 320, thereby releasably locking the assembly 300 to the housing 500. A clicking noise can be heard and serves as confirmation that the assembly 300 is locked with the housing 500.

In this locked position, the assembly 300 (substrate 130, cover 310, PCB 150) is intimately disposed within the space 571. This further serves to securely attach the assembly 300 to the housing 500. In addition, the locking member 570 (latch) also engages and releasably interlocks with the assembly 300 to securely attach the assembly 300 to the housing 500. Moreover, the thumbscrews 531 can be used to further attach the assembly 300 to the housing 500 by rotating the rear end 535 to cause the forward end 533 to fasteningly engage the hollow fastening members 541 of the D-subminiature connector 110.

As shown in the figures, the bottommost section of the locked assembly 300 and housing 500 is the locking member 570.

As mentioned above, the housing 500 can be thought of as a half hood and it provides a number of advantages compared to a full hood design, similar to the one disclosed in Applicant's other patent application referenced above. The addition of the half hood 500 to the assembly 300 makes it no wider than a connector without any hood or overmolded jacket. This ability allows the use of a tie wrap or lacing cord to secure the wires to the housing 500, providing solid anchoring and strain relief.

It will be appreciated that the thumbscrews 531 can be eliminated and instead the other retaining and locking features of the housing 500 can be used as the means for locking the connector assembly to the housing 500.

FIGS. 20-22D illustrate a plate mount 600 according to a first embodiment for attachment to an electrical connector, such as the electrical connector 300. The plate mount 600 is intended to be attached to a plate 601 as shown using conventional techniques, as described below, including the use of fasteners 603 that extend outwardly from the plate 601.

The plate mount 600 has a body 610 that includes a front edge 612, a rear edge 614, a top surface 616, and a bottom surface 618. The body 610 has a main support section 620 that received and supports the electrical connector. The top surface 616 of the support section 620 represents a floor for receiving the electrical connector. The body 610 also includes a pair of side wall restraint members 630, 640 that are mirror images of one another. Each restraint member 630, 640 includes a vertical side wall 632 that extends upwardly from the top surface 615 of the support section 620. The restraint member 630, 640 also includes a bracket 650 that is used to seat against and for mounting the plate mount 600 to the plate 601.

The bracket 650 can be formed perpendicular to the vertical side wall 632. The bracket 650 can include an opening 652 through which the fastener 603 is received for attaching the plate mount 600 to the plate 601. For example, the fastener 603 can be a screw or stud; however, it can also be in the form of a rivet. Fastening hardware 609, such as a washer and nut, threadingly mates with the fastener 603 for attaching the plate mount 600 to the plate 601. The bracket 650 thus extends outwardly from the sides of the support section 620.

Each restraint member 630, 640 also includes a resilient clip 660 that has a degree of flexing action. As shown, the resilient clip 660 has a first section 662 bent inwardly from the vertical side wall 632 and a second section 664 that is angled outwardly from the first section 662. The first and second sections 662, 664 are formed and joined together so as to generally have a V-shape. The first and second sections 662, 664 thus join together alone a ridge 665 that represents the innermost member of the restraint member 630, 640 and the vertical side wall 632.

When the electrical connector is of a D-subminiature type, such as connector 300, the plate 601 includes an opening 605 through which the D-subminiature connector portion 110 is received when the plate mount 600 and electrical connector 300 attached thereto are securely mounted to the plate 601.

At the two comers of the rear edge 616 of the body 610, the plate mount 600 includes a pair of rear clips 670. The rear clips 670 preferably have some degree of resiliency (flexing action). Each rear clip 670 is in the form of an upstanding tab that extends upwardly from the support section 620. The upstanding tab 670 can include a vertical wall section 672 and angled top portion 674.

As shown in FIGS. 22A-D, the plate mount 600 is first attached to the plate 601 by passing the fasteners 603 through the openings 652 of the brackets 650 and then threadingly mating the hardware 609 to the fasteners 603 resulting in the plate mount 600 being securely attached to the plate 601. Next, the electrical connector 300 is inserted into the plate mount 600 with its forward section facing forward toward the plate 601. In this orientation, the D-subminiature connector 110 is received between the restraint members 630, 640 and is then received into the opening formed in the plate 601. The flexing action of the restraint members 630, 640 allows for the insertion and removal of the electrical connector 300 into the plate mount 600.

In the locked, fully inserted position, the D-subminiature connector 110 is positioned next to the vertical side walls 632 and the resilient clips 660 are positioned on either side of the terminal block 160. A side guide (vertical rail section) 633 extends from each side wall 632 toward the rear end 614 and is formed below the resilient clip 660 and serves to restrict side-to-side movement of electrical connector 300 within the plate mount 600.

It will be appreciated that vertical motion of the electrical connector 300 within the plate mount 600 is restricted by the resilient clips 660 that sit on the top surface of the substrate 130 of the electrical connector 300. Front-to-back movement of the electrical connector 300 is restricted by the rear clips 670 since the rear edge of the electrical connector 300 is positioned adjacent the rear clips 670.

The plate mount 600 can be formed of any number of different materials, including a plastic material or a metal, such as a sheet metal structure.

FIG. 22A shows the electrical connector 300 prior to insertion into the plate mount 600. FIG. 22B shows the electrical connector 300 being angled for insertion into the plate mount 600. FIG. 22C shows the forward end of the electrical connector 300 being received into the plate mount 600 with the rear end of the electrical connector 300 sitting on the angled top portion 674 of the upstanding tab 670. FIG. 22D shows the electrical connector 300 in the fully inserted position.

FIG. 23 shows a plate mount 700 according to another embodiment for receiving an electrical connector and for attachment to the plate 601. The plate mount 700 is in the form of a molded plastic member (unitary structure). The plate mount 700 is similar to plate mount 600 and functions in the same manner.

The plate mount 700 has a body 710 that includes a front edge 712, a rear edge 714, a top surface 716, and a bottom surface 718. The body 710 has a main support section 720 that received and supports the electrical connector. The top surface 716 of the support section 720 represents a floor for receiving the electrical connector. The body 710 also includes a pair of side wall restraint members 730, 740 that are mirror images of one another. Each restraint member 730, 740 includes a vertical side wall 732 that extends upwardly from the top surface 715 of the support section 720. The restraint member 730, 740 also includes a bracket 750 that is used to seat against and for mounting the plate mount 700 to the plate 601.

The bracket 750 can be formed perpendicular to the vertical side wall 732. The bracket 750 can include a thru opening through which the fastener 603 is received for attaching the plate mount 700 to the plate 601. For example, the fastener 603 can be a screw or stud; however, it can also be in the form of a rivet. Fastening hardware, such as a washer and nut, threadingly mates with the fastener 603 for attaching the plate mount 700 to the plate 601. The bracket 750 thus extends outwardly from the sides of the support section 720. In another embodiment, as shown, the bracket 750 can be a threaded insert for use with a machine screw 603 as opposed to a thru opening that receives a self tap screw.

Each restraint member 730, 740 also includes a resilient clip 760 that has a degree of flexing action. As shown, the resilient clip 760 has a first section 762 bent inwardly from the vertical side wall 732 and a second section 764 that is angled outwardly from the first section 762. The first and second sections 762, 764 are formed and joined together so as to generally have a V-shape. The first and second sections 762, 764 thus join together alone a ridge 765 that represents the innermost member of the restraint member 730, 740 and the vertical side wall 732.

At the two comers of the rear edge 716 of the body 710, the plate mount 700 includes a pair of rear clips 770. The rear clips 770 preferably have some degree of resiliency (flexing action). Each rear clip 770 is in the form of an upstanding tab that extends upwardly from the support section 720. The upstanding tab 770 can include a vertical wall section 772 and angled top portion 774. Unlike the rear clip of the previous embodiment, the rear clip 770 is a right angled structure in that it wraps around the side edges of the body section 720.

The mating between the electrical connector (electrical connector 300) and the plate mount 700 is essentially the same as the mating between the electrical connector 300 and the plate mount 600. In particular, the connector 300 is received into the plate mount 700 and the vertical motion of the electrical connector 300 within the plate mount 700 is restricted by the resilient clips 760 that sit on the top surface of the substrate 130 of the electrical connector 300. Front-to-back movement of the electrical connector 300 is restricted by the rear clips 770 since the rear edge of the electrical connector 300 is positioned adjacent the rear clips 770.

While the invention has been described in connection with certain embodiments thereof, the invention is capable of being practiced in other forms and using other materials and structures. Accordingly, the invention is defined by the recitations in the claims appended hereto and equivalents thereof.

What is claimed is:

1. An electrical connector comprising:

a D-subminiature connector assembly including:

a base;

a D-subminiature connector mounted to the base; and a header mounted to the base, the header having a plurality of internal contacts and an open rear end for receiving a receptacle that includes conductive contacts that are electrically connected to the internal contacts when the receptacle is fully inserted into and engaged with the header, wherein the base comprises a substrate to which the D-subminiature connector and header are mounted and a protective cover that is for placement over a printed circuit board and is arranged on an underside of the substrate.

2. The electrical connector of claim 1, wherein the internal contacts of the header are arranged in a single row for receiving the conductive contacts that are likewise arranged in a single row within the receptacle.

3. The electrical connector of claim 1, wherein a height of the header is less than a height of the D-subminiature connector.

4. The electrical connector of claim 1, wherein the protective cover has a first recess formed therein to receive contacts of the D-subminiature connector and a slot formed therein to receive the internal contacts of the header.

5. The electrical connector of claim 1, wherein the header is of a pluggable type in that the open second end is configured to lockingly mate with a plug portion of the receptacle resulting in the internal contacts being electrically connected to the contacts of the receptacle.

6. An electrical connector assembly comprising:

a D-subminiature connector assembly including:

a base including a substrate and a printed circuit board, the base including a first interlocking feature;

a D-subminiature connector mounted to the substrate, the D-subminiature connector having pin contacts;

a terminal block mounted to the substrate and spaced from the D-subminiature connector, the terminal block having individual terminal openings for receiving wires associated with an electrical cable, each terminal opening being defined by an axis that extends therethrough and intersects a horizontal plane containing the base, the terminal block including an extra terminal that is electrically connected to the pin contacts of the D-subminiature connector via the printed circuit board, wherein the circuit is completed by inserting a shield of the cable into the extra terminal; and a housing that is coupled to base of the D-subminiature connector assembly, the housing having a base portion having a support surface for supporting the connector assembly and a resilient latch member that is disposed below and is movable relative to the base portion to assist in attaching the connector assembly to the housing, wherein the latch member includes a second interlocking feature that is complementary to the first interlocking feature, the first and second interlocking features being configured such that when placed in registration with one another, the first and second interlocking features engage one another, thereby releasably locking the connector assembly to the housing.

7. The electrical connector assembly of claim 6, wherein the terminal openings are formed at an angle relative to the plane containing the base such that the terminal openings do not exceed the height of the D-subminiature connector and wherein the terminal block includes a first terminal block having the angled terminal openings and a second terminal block that includes terminal openings that are defined by an axis that is parallel to the horizontal plane.

8. The electrical connector assembly of claim 6, wherein the base further comprises a protective cover that is for placement over the printed circuit board and is arranged on an underside of the substrate, the protective cover having a first recess formed therein to receive contacts of the D-subminiature connector and a pair of slots formed therein to receive contacts of the terminal blocks.

9. An electrical connector comprising:

a D-subminiature connector assembly including:

a base;

a D-subminiature connector mounted to the base; and an Ethernet connector mounted to the base for receiving a modular plug that includes pins that are electrically connected to twisted pairs of wires contained in a single cable jacket, the Ethernet connector having a plurality of internal contacts and an open rear end for receiving the modular plug so that when the modular plug is inserted into the Ethernet connector, the pins of the plug are electrically connected to the internal contacts;

wherein the base comprises a substrate to which the D-subminiature connector and Ethernet connector are mounted and a protective cover that is for placement over a printed circuit board and is arranged on an underside of the substrate.

10. The electrical connector of claim 9, wherein the protective cover has a first recess formed therein to receive contacts of the D-subminiature connector and a slot formed therein to receive the internal contacts of the Ethernet connector.

11. A housing for attachment to an electrical connector comprising:

a base portion having a support surface for supporting the electrical connector and a pair of upstanding fastening support structures that extend upward from the base portion; and a resilient latch member that is disposed below the base portion to assist in attaching the electrical connector to the housing, wherein a space is formed between the resilient latch member and the underside of the base portion; the latch member including a pair of locking members to assist in attaching the electrical connector to the housing;

wherein the housing has a height that is equal to or less than a height of the electrical connector and the housing has an open top to permit the electrical connector to be accessed.

12. The housing of claim 11, wherein the pair of locking members is disposed below the upstanding support structures.

13. The housing of claim 11, further comprising a pair of thumbscrew fastening members that are disposed through openings formed in vertical walls of the upstanding structures, the electrical connector having a pair of complementary fastener receptacles that threadingly mate with ends of the thumbscrews for attaching the electrical connector the housing.

14. The housing of claim 11, wherein front ends of the upstanding support structures extend beyond the forward edge of the latch member and a rear edge of the base portion extends beyond rear ends of the upstanding support structures.

15. The housing of claim 11, wherein the locking members are disposed at opposite sides of a forward edge of the latch member.

16. The housing of claim 11, wherein the electrical connector comprises a D-subminiature connector assembly including:

base;

a D-subminiature connector mounted to the base; and a terminal block mounted to the base and spaced from the D-subminiature connector, the terminal block having individual terminal openings for receiving wires associated with an electrical cable.

17. The housing of claim 11, wherein the support surface is formed between the upstanding support structures and includes a first section that extends to a front end of the housing and a second section that extends to a rear end of the housing, the first section being a substantially planar surface and the second surface being a sloped surface.

18. The housing of claim 17, wherein the sloped second section includes slots for cable ties.

19. The housing of claim 11, wherein latch member has a planar section that is formed between the two locking members, each locking member having an inclined upper surface.

20. The housing of claim 19, wherein the electrical connector includes a base portion that has a pair of notches formed on an underside thereof, wherein in a locked position, the locking members are received within the notches of the electrical connector.

21. A panel mount for use with an electrical connector comprising:

a support member having a front edge and a rear edge;

a pair of side wall supports that extend upwardly from the support member and serve to limit the side to side motion of the electrical connector, each side wall support includes a resilient side clip that has a free end closer to the rear edge, the side clip being spaced above an upper surface of the support member such that a space is formed between a bottom edge of the side clip and the upper surface, the side clip being configured to restrict vertical motion of the electrical connector;

a pair of mount members that extend laterally from the side wall supports for placement against a panel; and means for limiting front to back motion of the electrical connector.

22. The panel mount of claim 21, wherein the upper surface of the support member is planar and each mount member is a lateral flange that is perpendicular to a side edge of the support member.

23. The panel mount of claim 21, wherein each side clip includes a side guide that extends along a side edge of the support member toward the rear edge and being formed below one side clip and the means for limiting front to back motion of the electrical connector comprises a pair of rear clips that extend upwardly from the support member.

24. The panel mount of claim 21, wherein each side clip is a beveled structure that is angled inwardly toward a center of the support member, each mount member being a right angle bracket that includes an opening for receiving a fastener for securely attaching the mount plate to a structure.

25. The panel mount of claim 21, wherein the electrical connector comprises a D-subminiature connector assembly including:

a base;

a D-subminiature connector mounted to the base; and a terminal block mounted to the base and spaced from the D-subminiature connector, the terminal block having individual terminal openings for receiving wires associated with an electrical cable.

* * * * *